United States Patent [19]

Giordano

[11] Patent Number: 4,571,583

[45] Date of Patent: Feb. 18, 1986

[54] BARKING DOG SIMULATED ALARM SYSTEM

[76] Inventor: Salvatore J. Giordano, 3112 Wilkinson Ave., Bronx, N.Y. 10461.

[21] Appl. No.: 606,283

[22] Filed: May 2, 1984

[51] Int. Cl.[4] ..... G08B 15/00

[52] U.S. Cl. ..... 340/692; 340/541; 340/545; 340/566

[58] Field of Search ..... 340/692, 691, 566, 545, 340/541

[56] References Cited

U.S. PATENT DOCUMENTS

| | | | |
|---|---|---|---|
| 3,740,737 | 6/1973 | Carleson | 340/692 |
| 3,863,250 | 1/1975 | McCluskey, Jr. | 340/566 |
| 3,938,120 | 2/1976 | O'Connell | 340/692 |
| 4,023,151 | 5/1977 | Markham | 340/545 |
| 4,212,007 | 7/1980 | Reyes et al. | 340/545 |

*Primary Examiner*—Glen R. Swann, III

*Attorney, Agent, or Firm*—Richard L. Miller

[57] ABSTRACT

A barking dog simulated alarm system which is activated by vibration of any doors or windows. A prerecorded vicious dog sound is sounded which continues until the tape loop has been traversed and resumes when any portal is again disturbed. An alternative system is provided in which the barking sounds are switched back and forth between speakers at the end of each tape cycle. This makes the "dog" appear to move. The number of completed tape loops and therefore "dog" moves may be pre-determined.

3 Claims, 2 Drawing Figures

BARKING DOG SIMULATED ALARM SYSTEM

BACKGROUND OF THE INVENTION

The present invention relates generally to the field of security devices and more specifically to alarm systems which frighten burglars and intruders.

In our crime ridden society, many people have found it advantageous to keep a dog in order to scare away intruders. Ordinarily, a dog will bark loudly when someone rings the doorbell or knocks on the door. Most burglars want to be certain that no one is at home before attempting a burglary and will often test for this by knocking, ringing the doorbell, and then checking the front door to see if the door has been left unlocked. The response of a loud dog's bark to any of these is likely to dissuade the would-be burglar.

The keeping of dogs has certain inherent shortcomings. Not the least of these is that some people simply do not like dogs. Additionally, they tend to be expensive to keep, unsanitary, noisome and, occasionally, dangerous even to the owner.

A number of solutions to this dilemma have been proposed. L. Markham (U.S. Pat. No. 4,023,151) provides a communication appliance device which emits an audible message to anyone who breaks a beam of light or steps upon a pressure operated switch. While this might be used as an alarm, it may be easily circumvented by not stepping on the pressure switch or stepping over the light beam. Also, any sound emitted by the door mounted loudspeaker would not be likely to intimidate a burglar.

R. Reyes (U.S. Pat. No. 4,212,007) provides a combined burglar frightening device and alarm which proposally frightens a burglar by sounding a "woof-woof" sound while causing a model of a snarling dog's torso to move back and forth ominously. However, as common experience indicates, a dog sensing an intruder is not likely to remain in place and bob back and forth.

G. O'Connell (U.S. Pat. No. 3,938,120) provides a talking door sentinel which is mounted to the top of a door and emits a potentially threatening sound from a self contained speaker. Firstly, a burglar would have to succeed in opening the door before this alarm could even begin to sound. Also, the source of the sound would become instantly clear to even an inexperienced thief.

SUMMARY OF THE INVENTION

It is therefore a primary object of the present invention to provide a barking dog simulated alarm system which emits a threatening sound, such as that of a snarling doberman pinscher, if a door or window is so much as touched. This is accomplished by placing vibration switches at each of these portals. Each time a portal is disturbed the "dog" barks ferociously.

Another object is to provide a barking dog simulated alarm system which shuts off after one complete cycle of a continuous loop tape.

Another object is to provide another embodiment of the barking dog simulated alarm system in which the barking dog sounds are automatically switched between a number of speakers so that the dog appears to bark while moving about.

Another object is to cause this phantom movement after each cycle of the continuous loop tape.

Yet another object is to allow the predetermination of the number of cycles of phantom dog movement before the continuous loop tape player stops.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
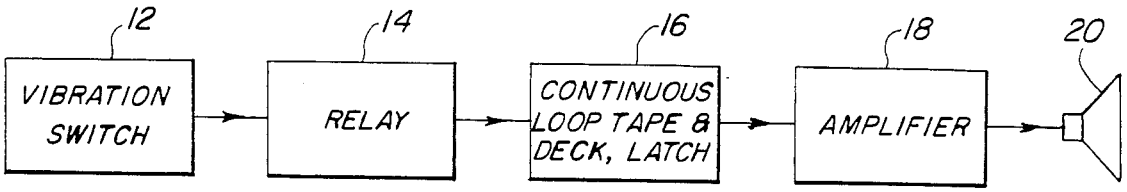
FIG. 1 is a block diagram of the invention.

In FIG. 1 a typical vibration switch 12 is shown. This switch may be attached to a window or a door. If the window or door are touched, thereby causing vibrations a pair of contacts inside the vibration switch 12 momentarily close. If it is desired that a number of portals be protected than any number of vibration switches may simply be paralleled.

The closure of contacts on vibration switch 12 causes the solenoid of relay 14 to activate closing relay contacts which activate continuous loop tape and tape deck with latch 16. This tape deck has a continuous loop tape which typically may be in cassette or cartridge format upon which may be recorded intimidating dog barks or snarls. An electrically conductive foil strip is glued to the tape which closes a pair of electrical contacts each time a cycle has been completed. At the end of each cycle this closure unlatches an integral relay which shuts off continuous loop tape and tape deck with latch 16.

The low level audio signal from continuous loop tape and tape deck with latch 16 is amplified by amplifier 18 and the dog barking sound is emitted by loud speaker 20.

Figure 2:
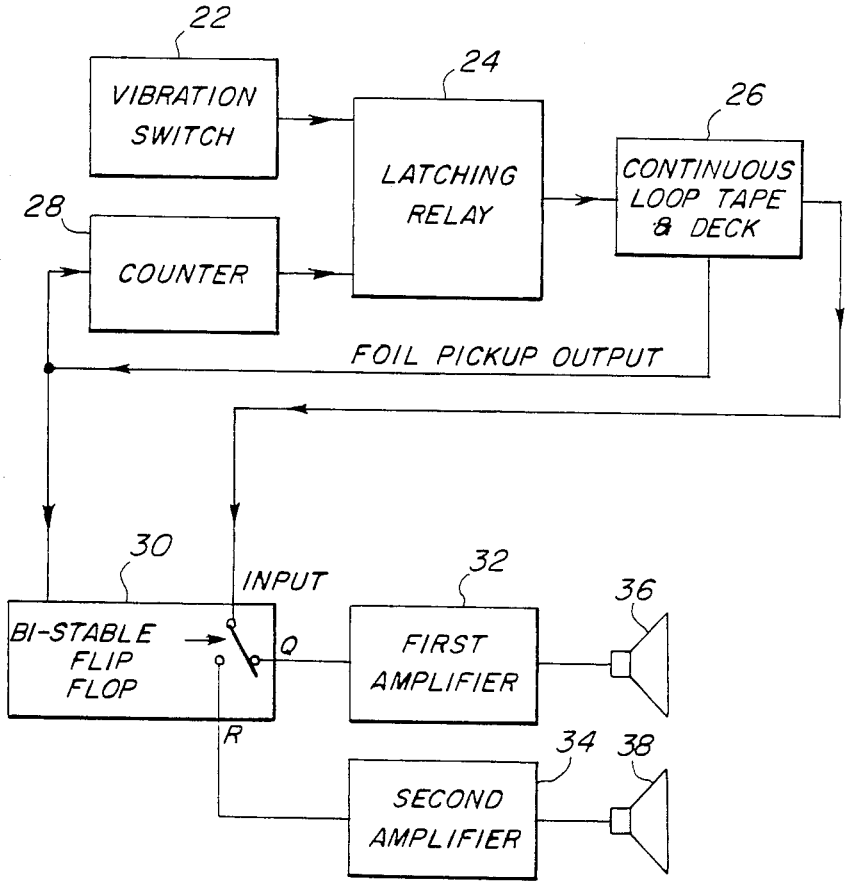
FIG. 2 is a block diagram of a second embodiment of the invention which simulates a barking dog running back and forth from one end of a house to the other.

In the alternative embodiment shown in FIG. 2, the vibration switch or switches typified by 22 cause latching relay 24 to switch its contacts from an initial open state, to a closed and stay latched state. These latched contacts activate continuous loop tape and tape deck 26. This tape deck, similarly, has a continuous loop tape which typically may be in cassette or cartridge format upon which may be recorded intimidating dog barks or snarls. An electrically conductive foil strip is glued to the tape which closes a pair of electrical contacts each time a cycle has been completed. The closure signal, labelled "foil pickup output" has two functions. First, it increments counter 28 so that the counter 28 unlatches latching relay 24 after a given number of tape cycles. Second, it triggers bi-stable flip flop 30 to change states at the end of each tape cycle. The low level audio output of continuous loop tape and tape deck 26 is fed to the "INPUT" of bi-stable flip flop 30. This input is alternately switched to the input of first amplifier 32 via bi-stable flip flop output "Q" and then to the input of second amplifier 34 via bi-stable flip flop output "R".

Each of amplifiers 32 and 34 alternately feeds an amplified audio signal to loud speakers 36 and 38 respectively. This causes the "dog's" fierce barks, growls, snarls and other guttural sounds to appear to traverse the house it is protecting.

The counter 28 may be either programmable by the user as to the number of counts required to cause the latching relay to switch back to it initial state (contacts open), or this may be a permanent design parameter chosen by design.

It should be well understood that although two amplifiers 32, and 34 are illustrated FIG. 2 in this embodiment one amplifier might be just as well used and that it is the signal of the menacing dog which is switched between speakers and this could be accomplished either before or after amplification.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A barking dog simulated alarm system, comprising in combination:

(a) a vibration switch with contacts that momentarily close when the portal to which said switch is attached is made to vibrate;

(b) a latching relay which is activated by the closure of said contacts on said vibration switch;

(c) a continuous loop tape on which is recorded a menacing audio sound signal;

(d) a tape deck which is activated by the closure of said contacts on said latching relay in order to reproduce from said type said menacing audio sound signal;

(e) at least two loudspeakers;

(f) means for shutting off said tape deck after a predetermined number of cycles of said continuous loop tape; and, (g) means for switching said audio signal from one to another of said speakers at the end of each of said cycles of said continuous loop tape in order to create the illusion of a moving threat such as a moving dog.

2. A barking dog simulated alarm system, as recited in claim 1, wherein said means for shutting off said tape deck after a pre-determined number of cycles of said continuous loop tape comprises a piece of electrically conductive foil which bridges a pair of electrical contacts at the end of each tape cycle wherein said pair of electrical contacts increments a counter which unlatches said latching relay when the number of passes of said continuous loop tape equals a preset value, thereby shutting off said tape deck.

3. A barking dog simulated alarm system, as recited in claim 1, wherein said means for switching said menacing audio sound signal from one to another of said speakers at the end of each of said cycles of said continuous loop tape in order to create the illusion of a moving threat such as a moving dog comprises: a bi-stable flip flop which is triggered each time a piece of electrically conductive foil bridges a pair of electrical contacts at the end of each tape cycle whereby said bi-stable flip flop switches said menacing audio sound signal back and forth between a pair of speakers.

* * * * *